US010770816B2

(12) United States Patent
Mellott et al.

(10) Patent No.: US 10,770,816 B2
(45) **Date of Patent: *Sep. 8, 2020**

(54) CONNECTOR ASSEMBLY AND SEAL

(71) Applicant: Aptiv Technologies Limited, St. Michael (BB)

(72) Inventors: Michael L. Mellott, Youngstown, OH (US); Glenn E. Robison, Youngstown, OH (US)

(73) Assignee: APTIV TECHNOLOGIES LIMITED, St. Michael (BB)

( * ) Notice: Subject to any disclaimer, the term of this patent is extended or adjusted under 35 U.S.C. 154(b) by 0 days.

This patent is subject to a terminal disclaimer.

(21) Appl. No.: 16/532,797

(22) Filed: Aug. 6, 2019

(65) Prior Publication Data

US 2019/0363470 A1 Nov. 28, 2019

Related U.S. Application Data

(63) Continuation of application No. 15/867,304, filed on Jan. 10, 2018, now Pat. No. 10,573,989.
(Continued)

(51) Int. Cl.
*H01R 13/44* (2006.01)
*H01R 13/187* (2006.01)
(Continued)

(52) U.S. Cl.
CPC ..... *H01R 13/187* (2013.01); *H01R 13/052* (2013.01); *H01R 13/113* (2013.01);
(Continued)

(58) Field of Classification Search
CPC .. H01R 13/187; H01R 13/052; H01R 13/113; H01R 13/28; H01R 13/53; H01R 24/66;
(Continued)

(56) References Cited

U.S. PATENT DOCUMENTS 4,810,208 A * 3/1989 Hayes ..... H01R 13/5208 439/281
4,829,255 A * 5/1989 VanDerStuyf ..... G01R 31/69 324/538
(Continued)

FOREIGN PATENT DOCUMENTS

CN 101536270 A 9/2009
CN 201498702 U 6/2010
(Continued)

*Primary Examiner* — Truc T Nguyen
(74) *Attorney, Agent, or Firm* — Billion & Armitage; Robert Myers

(57) ABSTRACT

A connector assembly includes a first-housing, a second-housing, and a seal. The second-housing is configured to mate with the first-housing. The second-housing has a seal-support surface having a first-surface and a second-surface perpendicular to the first-surface and generally forming an L-shape. The seal-support surface includes a plurality of seal-hangers projecting laterally from the first-surface. The seal is in direct contact with the seal-support surface. The seal defines a wall and a lip extending laterally from the wall. The wall defines an inner-surface that engages the first-surface and an outer-surface that engages the first-housing. The wall further defines a plurality of apertures configured to receive the plurality of seal-hangers. The lip defines a base that engages the second-surface and a top that engages a leading-edge of the first-housing. The plurality of seal-hangers are configured to inhibit bunching or rolling of the wall when the first-housing is mated with the second-housing.

19 Claims, 5 Drawing Sheets

Related U.S. Application Data

(60) Provisional application No. 62/539,656, filed on Aug. 1, 2017.

(51) Int. Cl.

| | |
|---|---|
| ***H01R 13/193*** | (2006.01) |
| ***H01R 13/621*** | (2006.01) |
| ***H01R 13/26*** | (2006.01) |
| ***H01R 13/502*** | (2006.01) |
| ***H01R 13/52*** | (2006.01) |
| ***H01R 13/62*** | (2006.01) |
| ***H01R 13/66*** | (2006.01) |
| ***H01R 13/05*** | (2006.01) |
| ***H01R 13/11*** | (2006.01) |
| ***H01R 13/28*** | (2006.01) |
| ***H01R 13/53*** | (2006.01) |
| ***H01R 24/66*** | (2011.01) |
| ***H01R 43/16*** | (2006.01) |
| ***H01R 13/58*** | (2006.01) |
| *H01R 13/207* | (2006.01) |
| *H01R 4/50* | (2006.01) |
| *H01R 13/633* | (2006.01) |

(52) U.S. Cl.

CPC ..... *H01R 13/193* (2013.01); *H01R 13/26* (2013.01); *H01R 13/28* (2013.01); *H01R 13/44* (2013.01); *H01R 13/502* (2013.01); *H01R 13/5202* (2013.01); *H01R 13/5208* (2013.01); *H01R 13/5219* (2013.01); *H01R 13/53* (2013.01); *H01R 13/5812* (2013.01); *H01R 13/62* (2013.01); *H01R 13/6215* (2013.01); *H01R 13/665* (2013.01); *H01R 24/66* (2013.01); *H01R 43/16* (2013.01); *H01R 4/5091* (2013.01); *H01R 13/207* (2013.01); *H01R 13/6335* (2013.01); *H01R 13/6683* (2013.01); *H01R 2201/26* (2013.01)

(58) Field of Classification Search

CPC ..... H01R 43/16; H01R 13/5219; H01R 13/5208; H01R 13/5812; H01R 13/193; H01R 13/44; H01R 13/6215; H01R 13/26; H01R 4/5091; H01R 13/6335; H01R 13/6683; H01R 2201/26; H01R 13/20

See application file for complete search history.

(56) References Cited

U.S. PATENT DOCUMENTS

| | | | | |
|---|---|---|---|---|
| 5,588,884 | A | 12/1996 | Rudoy et al. | |
| 5,879,178 | A * | 3/1999 | Koumatsu | H01R 13/5219 439/271 |
| 6,190,203 | B1 * | 2/2001 | Murakami | H01R 13/5219 439/274 |
| 6,416,340 | B2 | 7/2002 | Schaefer et al. | |
| 7,011,539 | B1 * | 3/2006 | Nagy | H01R 13/5219 439/271 |
| 7,044,762 | B1 * | 5/2006 | Hong | H01R 13/5213 439/275 |
| 8,317,530 | B2 * | 11/2012 | Sawairi | H01R 13/5219 439/271 |
| 9,825,398 | B1 * | 11/2017 | Uchida | H01R 13/5219 |
| 10,177,488 | B2 * | 1/2019 | Zhao | H01R 13/5219 |
| 10,367,292 | B2 * | 7/2019 | Furuya | H01R 13/516 |
| 10,490,931 | B2 * | 11/2019 | Furuya | H01R 13/5208 |
| 2002/0025732 | A1 | 2/2002 | Hsieh | |
| 2002/0039862 | A1 * | 4/2002 | Nishide | H01R 13/6456 439/701 |
| 2003/0194919 | A1 | 10/2003 | Hsieh et al. | |
| 2004/0219840 | A1 | 11/2004 | Wise | |
| 2005/0212360 | A1 * | 9/2005 | Kaminski | H01R 13/74 307/10.1 |
| 2007/0004274 | A1 * | 1/2007 | Tabata | H01R 13/514 439/540.1 |
| 2011/0053404 | A1 | 3/2011 | Tsuruta et al. | |
| 2011/0086544 | A1 * | 4/2011 | Yoshioka | H01R 13/4362 439/587 |
| 2011/0217859 | A1 * | 9/2011 | Kimura | H01R 13/52 439/271 |
| 2012/0156947 | A1 | 6/2012 | Tyler | |
| 2012/0164850 | A1 * | 6/2012 | Kobayashi | G01K 7/023 439/55 |
| 2013/0130535 | A1 * | 5/2013 | Plazio | H01R 13/502 439/350 |
| 2015/0207263 | A1 * | 7/2015 | Fabre | H01R 13/506 439/271 |

FOREIGN PATENT DOCUMENTS

| | | | |
|---|---|---|---|
| CN | 201541002 | U | 8/2010 |
| CN | 102114925 | A | 7/2011 |
| CN | 106299808 | A | 1/2017 |
| EP | 557898 | A1 | 9/1993 |
| EP | 985809 | A2 | 3/2000 |
| EP | 2790273 | A1 | 10/2014 |

* cited by examiner

CONNECTOR ASSEMBLY AND SEAL

CROSS-REFERENCE TO RELATED APPLICATION

This is a continuation application and claims the benefit under 35 U.S.C. § 120 of U.S. patent application Ser. No. 15/867,304, filed Jan. 10, 2018, the entire disclosure of which is hereby incorporated herein by reference. This application also claims the benefit under 35 U.S.C. § 119(e) of U.S. Provisional Patent Application No. 62/539,656, filed Aug. 1, 2017, the entire disclosure of which is hereby incorporated herein by reference.

TECHNICAL FIELD OF INVENTION

This disclosure generally relates to a connector assembly, and more particularly relates to a connector assembly that includes a seal.

BRIEF DESCRIPTION OF DRAWINGS

The present invention will now be described, by way of example with reference to the accompanying drawings, in which.

DETAILED DESCRIPTION

Figure 1:
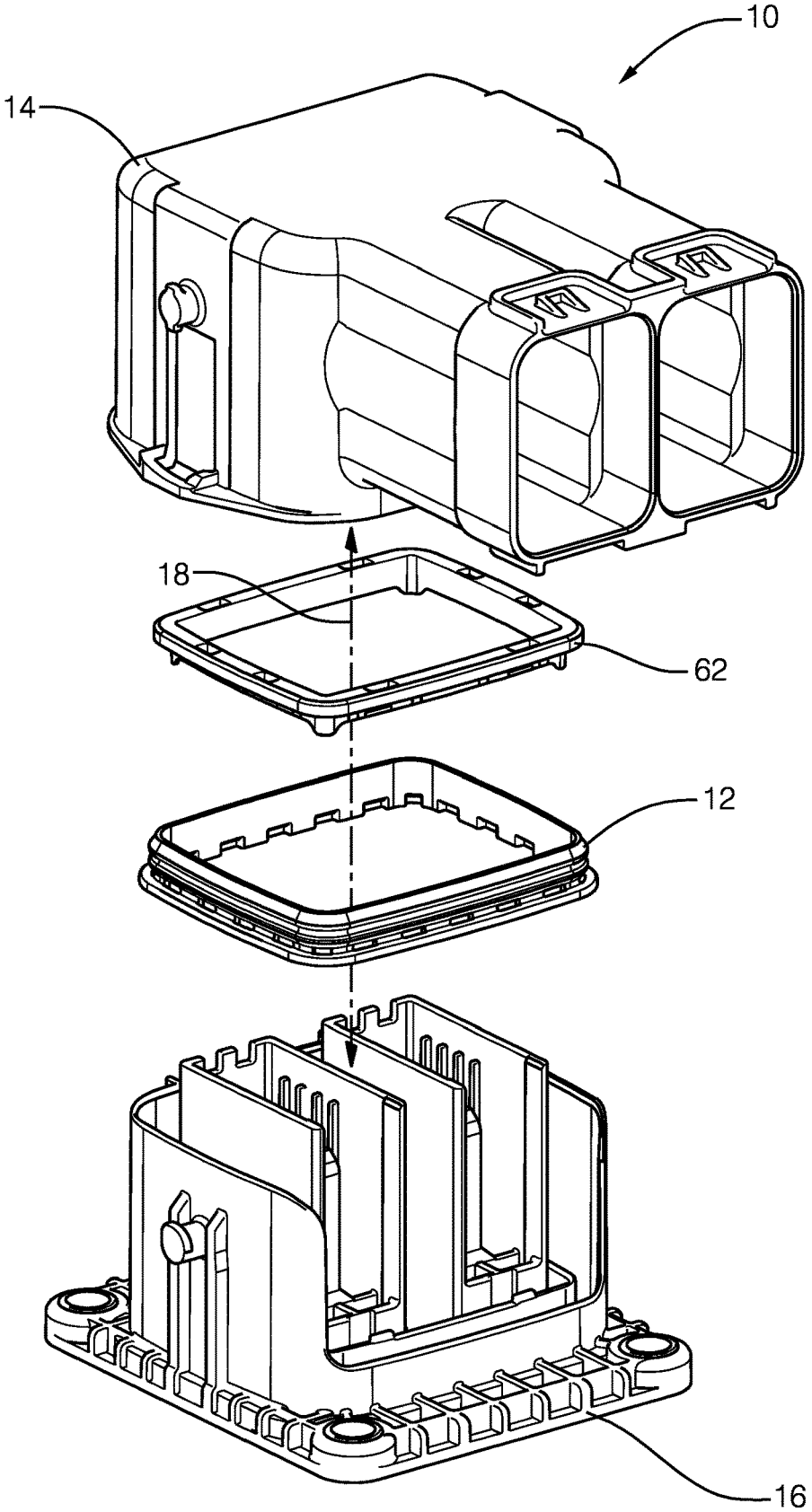
FIG. 1 is an exploded-view of an illustration of a connector assembly in accordance with one embodiment.

FIG. 1 is an exploded-view of a connector assembly 10. The connector assembly 10 is an improvement over previous connector assemblies because the connector assembly 10 includes a seal 12 configured to inhibit an unwanted displacement of the seal 12 when the connector assembly 10 is mated and unmated. This provides a technical benefit of improving the sealing-quality of the seal 12 when the connector assembly 10 is exposed to extreme conditions of heat and moisture. The connector assembly 10 includes a first-housing 14 and a second-housing 16 configured to mate with the first-housing 14 along a mating-axis 18. The first-housing 14 and second-housing 16 may include electrical-terminals (not shown) that may attach to a vehicle electrical system (not shown). The first-housing 14 and the second-housing 16 are formed of any dielectric material capable of electrically isolating portions of the electrical-terminals, and is preferably a polyamide (NYLON) material.

Figure 2:
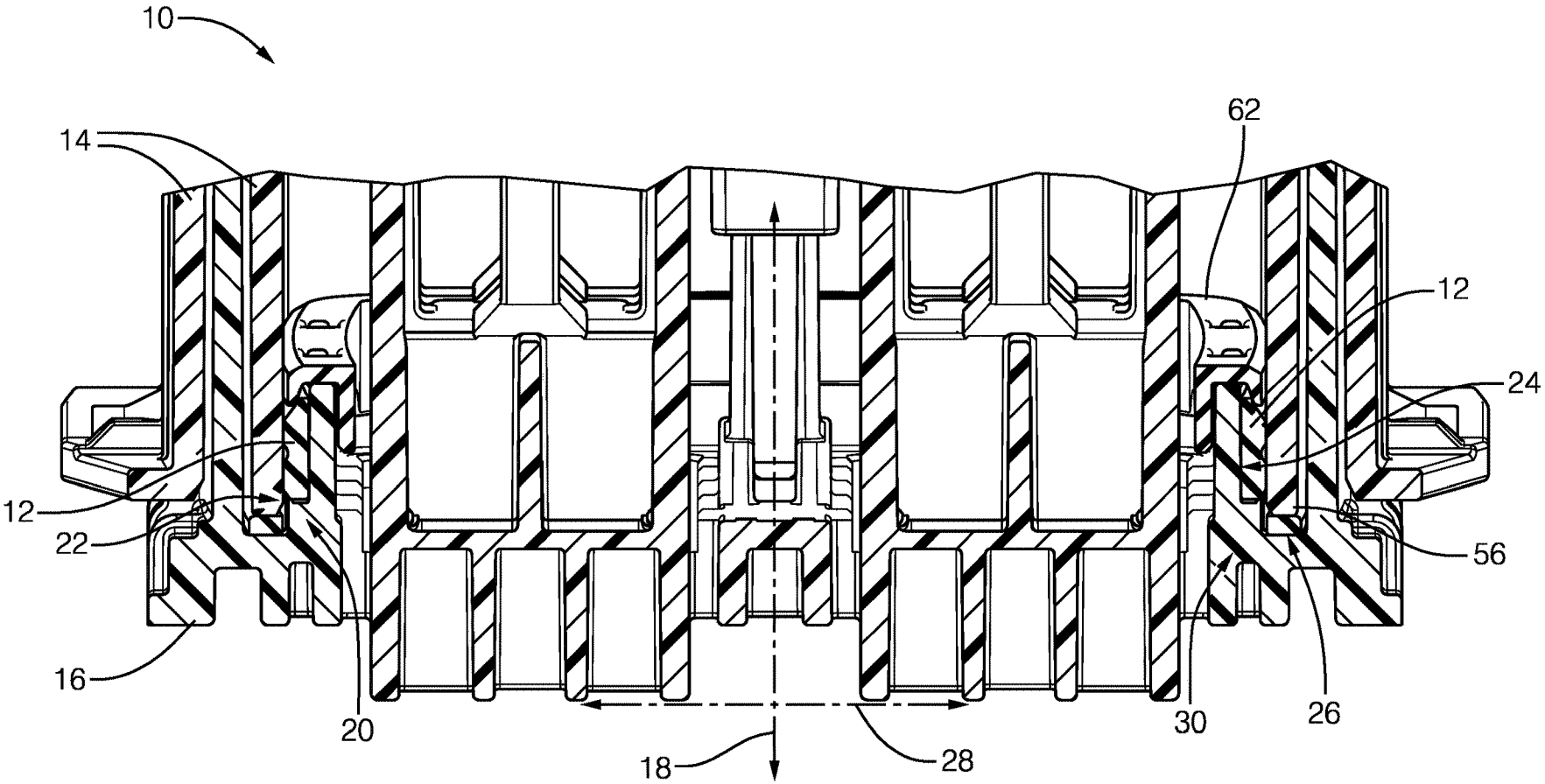
FIG. 2 is an cross-section of the mated connector assembly of FIG. 1 in accordance with one embodiment.

FIG. 2 is a cross-section view of the mated connector assembly 10 and illustrates a sealing-interface between the first-housing 14 and second-housing 16. The second-housing 16 has an outer-perimeter 20 disposed within the first-housing 14 which established the sealing-interface. The outer-perimeter 20 includes a seal-support surface 22 having a first-surface 24 aligned parallel with the mating-axis 18, and a second-surface 26 extending outwardly from the first-surface 24 in a lateral-direction 28 perpendicular to the first-surface 24, and generally forming an L-shape 30.

Figure 3:
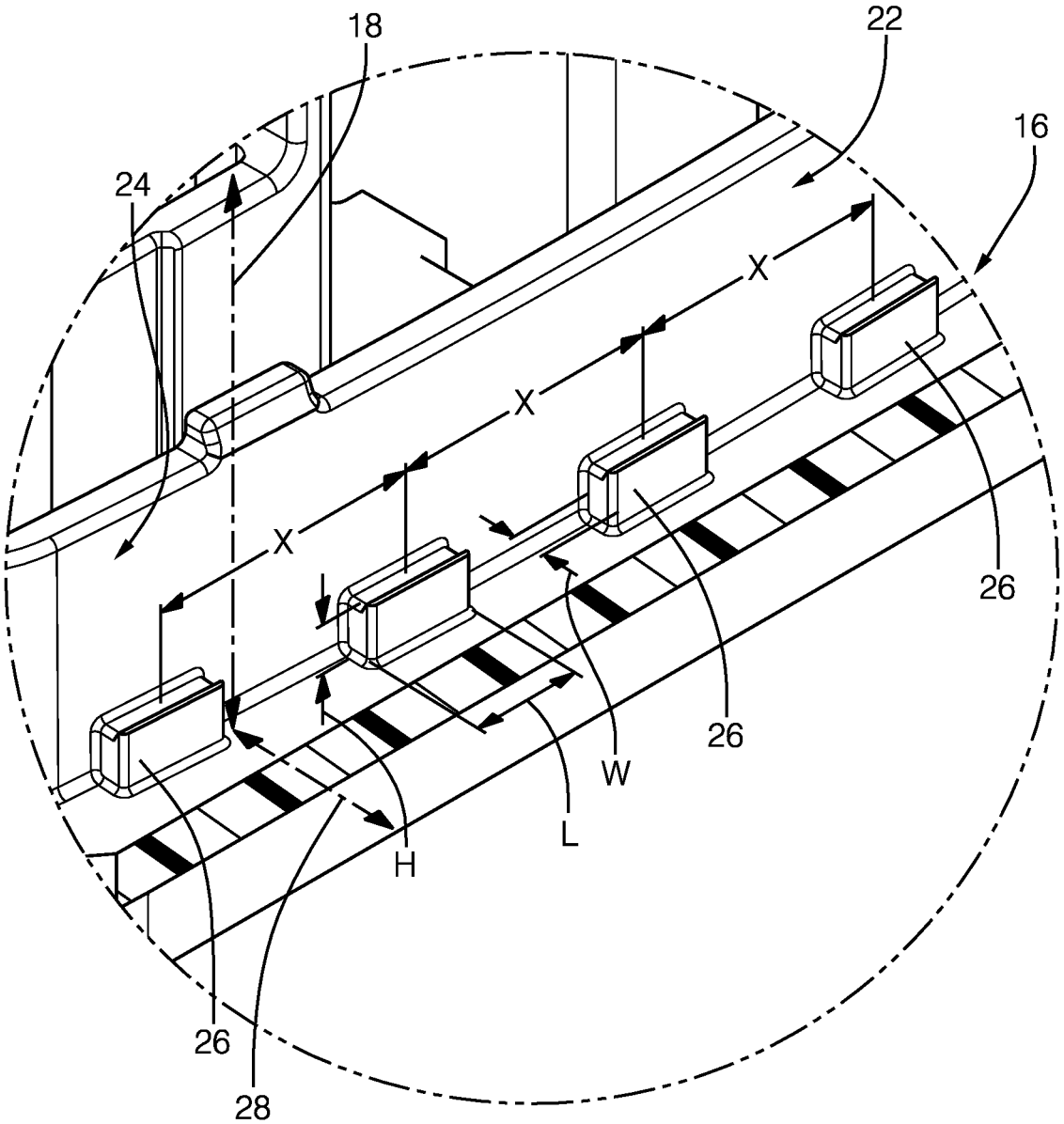
FIG. 3 is an illustration of a second-housing isolated from the connector assembly of FIG. 1 in accordance with one embodiment.

FIG. 3 illustrates a portion of the second-housing 16 isolated from the first-housing 14 and the seal 12, and exposes the seal-support surface 22. The seal-support surface 22 includes a plurality of seal-hangers 32 projecting outward from the first-surface 24 in the lateral-direction 28. The plurality of seal-hangers 32 are distributed evenly (i.e. equivalent spacing between each of the seal-hangers 32) around the seal-support surface 22, and in the example illustrated in FIG. 3 are spaced in a range from 10 mm to 15 mm center-to-center, and preferably in the range from 11.7 mm to 11.95 m center-to-center. The plurality of seal-hangers 32 project upwardly from the second-surface 26 along the mating-axis 18, and further project outwardly from a portion of the first-surface 24. Each of the seal-hangers 32 have equivalent dimensions (i.e. are identical in geometry along all three axes) and in the example illustrated in FIG. 3 are shown as having a length (L) of 4.8 mm, a width (W) of 1.45 mm, and a height (H) of 2.3 mm. The inventors have discovered that this combination of spacing and dimensioning of the plurality of seal-hangers 32 provides adequate support for the seal 12 without compromising the sealing-quality of the connector assembly 10.

Figure 4:
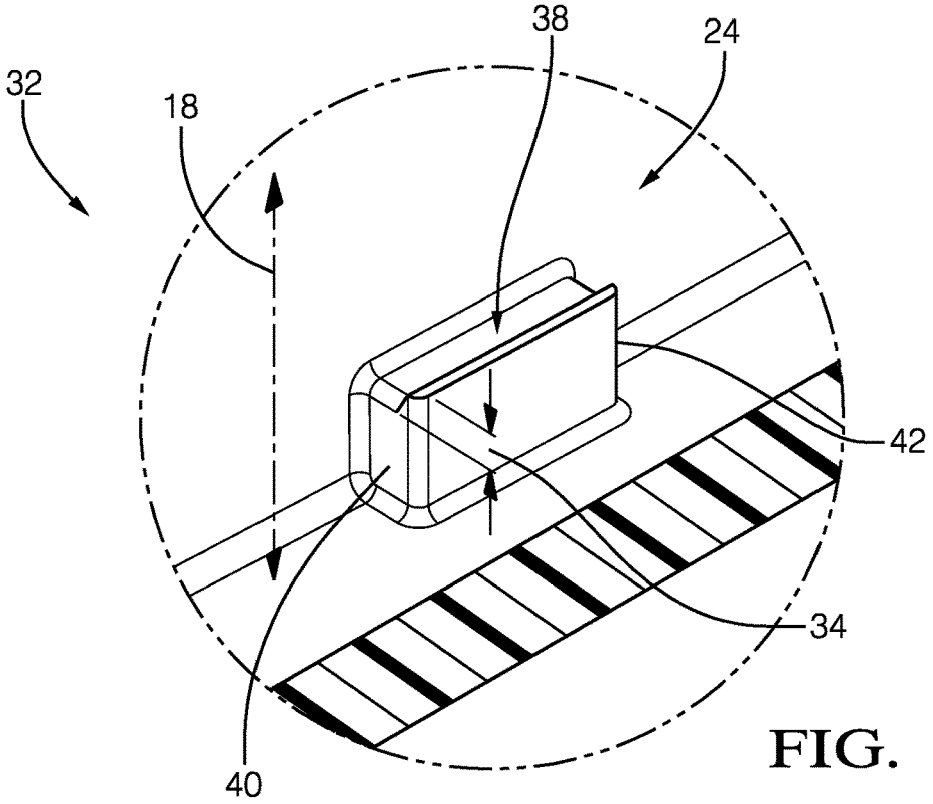
FIG. 4 is a perspective-view of an illustration of a seal-hanger of the second-housing of FIG. 3 in accordance with one embodiment.

FIG. 4 is a close-up perspective-view of one seal-hanger 32 from FIG. 4 and illustrates a retention-lip 34 configured to retain a wall 36 of the seal 12 against the first-surface 24. The retention-lip 34 extends beyond a top-surface 38 of each seal-hanger 32 along the mating-axis 18 for a distance of 0.1 mm to 1.0 mm beyond the top-surface 38, and in the example illustrated in FIG. 4 extends for a distance 0.25 mm beyond the top-surface 38. The retention-lip 34 extends beyond the top-surface 38 from a first-side 40 to a second-side 42 of each seal-hanger 32 (i.e. extends all along an outside-face of each seal-hanger 32). The plurality of seal-hangers 32 are configured to inhibit bunching or rolling of the wall 36 of the seal 12 when the first-housing 14 is mated with the second-housing 16, a condition that may comprise the sealing-quality of the connector assembly 10. As used herein, "bunching or rolling" refers to a deformation of the seal 12 along the mating-axis 18 where the wall 36 of the seal 12 is either compressibly shortened, or a portion of the seal 12 separated from a portion the seal-support surface 22.

Figure 5:
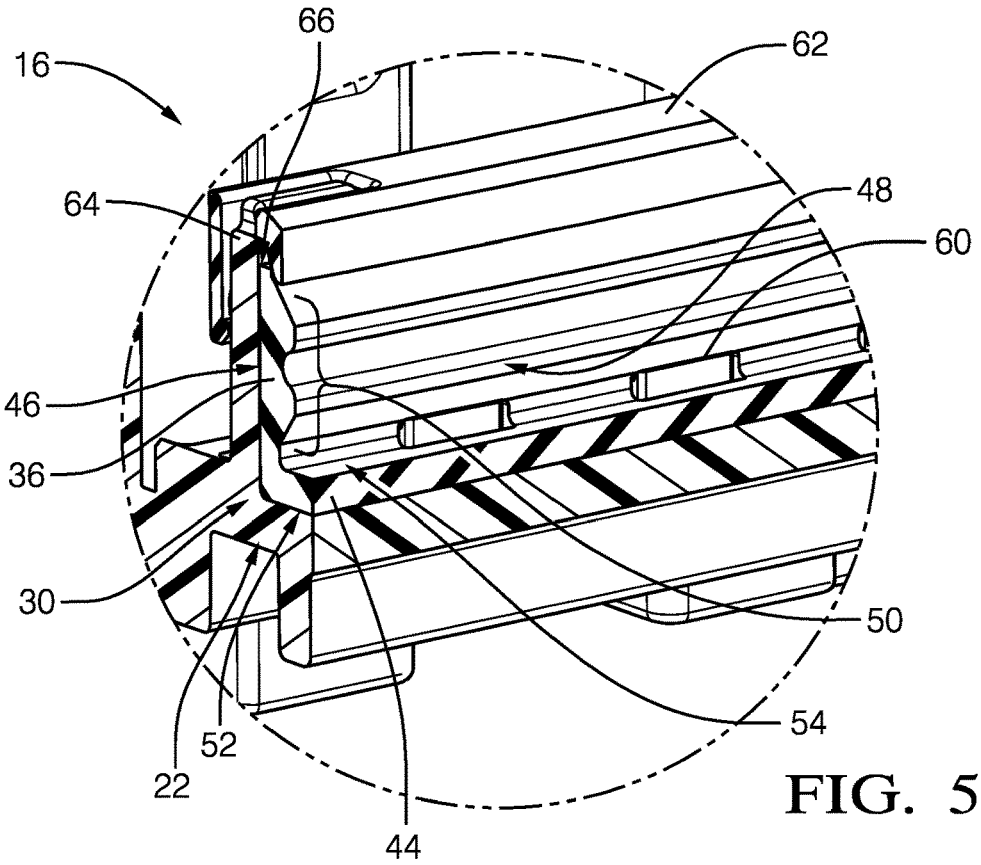
FIG. 5 is a section-view of the second-housing of the connector assembly of FIG. 2 in accordance with one embodiment.

FIG. 5 is a section-view of the second-housing 16 illustrating the seal 12 installed on the second-housing 16. The seal 12 is a continuous compliant seal 12, preferably formed of a silicone rubber, in direct contact with the seal-support surface 22. The seal 12 defines the wall 36 and a lip 44 extending from the wall 36 in the lateral-direction 28 and generally forming the L-shape 30. The wall 36 defines an inner-surface 46 that engages the first-surface 24 of the seal-support surface 22 and an outer-surface 48 that engages the first-housing 14. The wall 36 defines a plurality of horizontal-ribs 50 extending beyond the outer-surface 48 in the lateral-direction 28, and in the example illustrated in FIG. 5, the wall 36 includes two horizontal-ribs 50. In an alternative embodiment, the wall 36 includes three horizontal-ribs 50.

The lip 44 of the seal 12 defines a base 52 that engages the second-surface 26 of the seal-support surface 22 and a top 54 that engages a leading-edge 56 of the first-housing 14 (see FIG. 2). The lip 44 is configured to extend beyond the leading-edge 56 of the first-housing 14 so that the leading-edge 56 imparts a compressive-force on the lip 44 when the first-housing 14 is mated with the second-housing 16. This compressive-force has the technical benefit of improving the sealing of the connector assembly 10 and dampens vibrations that may be transmitted through the connector assembly 10.

Figure 6:
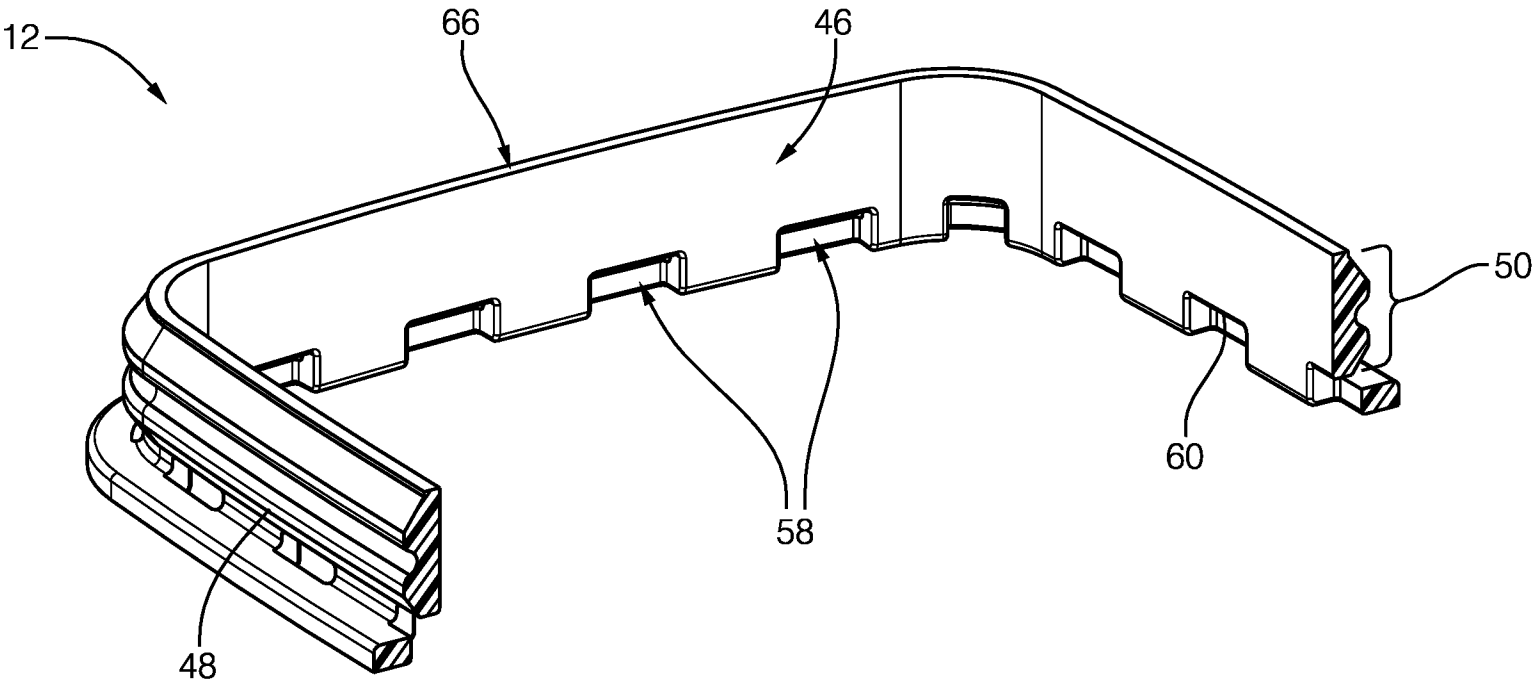
FIG. 6 is a perspective-view of a half-section of a seal isolated from the second-housing of FIG. 2 in accordance with one embodiment.

FIG. 6 is a perspective-view of a half-section of the seal 12 isolated from the second-housing 16 and illustrates both the inner-surface 46 and the outer-surface 48. The wall 36 further defines a plurality of apertures 58 configured to receive the plurality of seal-hangers 32 as shown in FIG. 5. The plurality of apertures 58 are distributed evenly around a perimeter of the seal 12 and have the same spacing as the evenly distributed seal-hangers 32 described above. Each of the plurality of apertures 58 have equivalent dimensions (i.e. are identical in geometry along all three axes) and in the example illustrated in FIG. 6 are shown as having a length (L) of 5.5 mm, a width (W) of 1.45 mm, and a height (H) of 2.3 mm. The length of the apertures 58 is slightly larger than the length of the seal-hanger 32 to aid in the installation of the seal 12 over the seal-hangers 32. The apertures 58 are located at an intersection between the wall 36 and the lip 44 of the seal 12 and extend through the wall 36 from the inner-surface 46 to the outer-surface 48 of the seal 12. The apertures 58 define a top-wall 60 that is in direct contact with the top-surface 38 of each seal-hanger 32 enabling the wall 36 to be supported by the plurality of seal-hangers 32.

Referring back to FIG. 5, the second-housing 16 further includes a seal-retainer 62 attached to a tip 64 of the seal-support surface 22 of the second-housing 16 that is configured to inhibit bunching or rolling of the wall 36 of the seal 12 when the first-housing 14 and the second-housing 16 are un-mated. The seal-retainer 62 is characterized by a continuous band of material encircling the tip 64 of the seal-support surface 22 and may be formed of a similar material as the second-housing 16. The seal-retainer 62 captures a top-edge 66 of the seal 12 and inhibits movement of the seal 12 relative to the seal-support surface 22 as the first-housing 14 is moved along the mating-axis 18 away from the second-housing 16 during the un-mating process.

Accordingly, a connector assembly 10 is provided. The connector assembly 10 is an improvement over other connector assemblies because the connector assembly 10 includes the plurality of seal-hangers 32 and the seal-retainer 62 that inhibit the bunching or rolling of the wall 36 of the continuous compliant seal 12 when the connector assembly 10 is both mated and un-mated.

While this invention has been described in terms of the preferred embodiments thereof, it is not intended to be so limited, but rather only to the extent set forth in the claims that follow. Moreover, the use of the terms first, second, upper, lower, etc. does not denote any order of importance, location, or orientation, but rather the terms first, second, etc. are used to distinguish one element from another. Furthermore, the use of the terms a, an, etc. do not denote a limitation of quantity, but rather denote the presence of at least one of the referenced items.

We claim:

1. A method comprising:

mating a first-housing of a connector assembly to a second-housing of the connector assembly;

the second-housing configured to mate with the first-housing along a mating-axis and includes an outer-perimeter disposed within the first-housing;

the second-housing including a seal configured to inhibit a contaminant from entering the connector assembly;

the seal defining a plurality of apertures;

the plurality of apertures extending through a wall of the seal from an inner-surface to an outer-surface of the seal;

the outer-surface of the seal defining a plurality of horizontal-ribs extending beyond the outer-surface of the seal in a lateral-direction the second-housing further including a plurality of seal-hangers configured to inhibit a deformation of the seal along the mating-axis when the first-housing is mated with the second-housing;

the plurality of seal-hangers extending through the plurality of apertures; wherein the plurality of seal-hangers support the wall of the seal and engage a portion of the outer-surface of at least one of the plurality of horizontal-ribs.

2. The method of claim 1, wherein the outer-perimeter includes a seal-support surface having a first-surface aligned parallel with the mating-axis and a second-surface aligned perpendicular to the first-surface.

3. The method of claim 2, wherein a lip of the seal defines a base that engages the second-surface and a top that engages a leading-edge of the first-housing.

4. The method of claim 3, wherein the lip of the seal extends beyond the leading-edge of the first-housing, the lip imparting a compressive-force between the first-housing and the second-housing when the first-housing is mated with the second-housing.

5. The method of claim 2, wherein the plurality of seal-hangers extend outwardly from the first-surface in the lateral-direction.

6. The method of claim 2, wherein each seal-hanger in the plurality of seal-hangers includes a retention-lip configured to retain the wall of the seal to the first-surface.

7. The method of claim 6, wherein the retention-lip extends beyond a top-surface of each seal-hanger along the mating-axis.

8. The method of claim 2, wherein the plurality of seal-hangers project outward from the first-surface in the lateral-direction.

9. The method of claim 2, wherein the plurality of seal-hangers further project, upwardly from the second-surface along the mating-axis.

10. The method in accordance with claim 1, wherein the plurality of apertures define a top-wall that is in direct contact with each seal-hanger.

11. A connector assembly, comprising:

a first-housing;

a second-housing;

the second-housing configured to mate with the first-housing along a mating-axis and includes an outer-perimeter disposed within the first-housing;

the second-housing including a seal configured to inhibit a contaminant from entering the connector assembly;

the seal defining a plurality of apertures;

the plurality of apertures extending through a wall of the seal from an inner-surface to an outer-surface of the seal;

the outer-surface of the seal defining a plurality of horizontal-ribs extending beyond the outer-surface of the seal in a lateral-direction the second-housing further including a plurality of seal-hangers configured to inhibit a deformation of the seal along the mating-axis when the first-housing is mated with the second-housing;

the plurality of seal-hangers extending through the plurality of apertures; wherein the plurality of seal-hangers support the wall of the seal and engage a portion of the outer-surface of at least one of the plurality of horizontal-ribs.

12. The connector assembly of claim 11, wherein the outer-perimeter includes a seal-support surface having a first-surface aligned parallel with the mating-axis and a second-surface aligned perpendicular to the first-surface.

13. The connector assembly of claim 12, wherein a lip of the seal defines a base that engages the second-surface and a top that engages a leading-edge of the first-housing.

14. The connector assembly of claim 13, wherein the lip of the seal extends beyond the leading-edge of the first-housing, the lip configured to impart a compressive-force between the first-housing and the second-housing when the first-housing is mated with the second-housing.

15. The connector assembly of claim 12, wherein the plurality of seal-hangers extend outwardly from the first-surface in the lateral-direction.

16. The connector assembly of claim 12, wherein each seal-hanger in the plurality of seal-hangers includes a retention-lip configured to retain the wall of the seal to the first-surface.

17. The connector assembly of claim 16, wherein the retention-lip extends beyond a top-surface of each seal-hanger along the mating-axis.

18. The connector assembly of claim 12, wherein the plurality of seal-hangers further project upwardly from the second-surface along the mating-axis.

19. The connector assembly in accordance with claim 11, wherein the plurality of apertures define a top-wall that is in direct contact with each seal-hanger.

* * * * *